United States Patent [19]

Araki

[11] 4,330,235

[45] May 18, 1982

[54] COOLING APPARATUS FOR GAS TURBINE BLADES

[75] Inventor: Tatsuo Araki, Tokyo, Japan

[73] Assignee: Tokyo Shibaura Denki Kabushiki Kaisha, Japan

[21] Appl. No.: 125,103

[22] Filed: Feb. 27, 1980

[30] Foreign Application Priority Data

Feb. 28, 1979 [JP] Japan ..... 54/23199

[51] Int. Cl.[3] ..... F01D 5/08; F01D 5/18

[52] U.S. Cl. ..... 416/96 R; 416/97 R

[58] Field of Search ..... 416/96 R, 97 R, 95; 415/115

[56] References Cited

U.S. PATENT DOCUMENTS

| | | | |
|---|---|---|---|
| 3,446,481 | 5/1969 | Kydd | 415/115 |
| 3,446,482 | 5/1969 | Kydd | 416/96 R |
| 3,807,892 | 4/1974 | Frei et al. | 416/96 R |
| 3,816,022 | 6/1974 | Day | 416/97 R |
| 3,902,819 | 9/1975 | Holchendler et al. | 416/97 R |
| 4,156,582 | 5/1979 | Anderson | 416/96 R |
| 4,179,240 | 12/1979 | Kothmann | 416/96 R |
| 4,236,870 | 12/1980 | Hucul et al. | 416/97 R |

*Primary Examiner*—Robert E. Garrett

*Attorney, Agent, or Firm*—Finnegan, Henderson, Farabow, Garrett & Dunner

[57] ABSTRACT

In apparatus and a method for cooling a gas turbine blade, coolant in a liquid state, such as water, flows from a blade root portion toward an outer blade end portion under centrifugal force through one or more liquid coolant passages travelling longitudinally within the blade, and such liquid flow coolant is introduced through a channel to one or more nozzles for converting the liquid flow to a mist. The mist flows from the outer blade end portion toward the blade root portion through one or more mist-flow coolant passages and, having absorbed heat includes mist and gaseous vapor, is discharged from the blade into the motive fluid.

7 Claims, 11 Drawing Figures

COOLING APPARATUS FOR GAS TURBINE BLADES

BACKGROUND OF THE INVENTION

This invention relates to cooling apparatus for gas turbine blades, and more particularly to such apparatus utilizing a liquid coolant.

As is well-known in the art, one of the most effective methods for increasing efficiency of gas turbines is to elevate the inlet temperature of the motive fluid to the turbines. However, allowable temperature of metallic material used for turbine blades and the like is, generally, around 800° C. Accordingly, employment of motive fluid with temperatures higher than such value without overheating the metal constituents requires that the members forming the turbines be cooled effectively and particularly that the blades be properly cooled.

Methods for cooling blades are divided roughly into air-cooling and liquid-cooling in which water is usually used as the coolant. Water is a superior coolant to air in general for two reasons. First, water has a higher thermal conductivity, and second, water can absorb more heat per unit mass due to its larger specific heat and to the available water-steam phase change. Thus, various ways of water-cooling turbine blades have been developed.

In such liquid-cooled rotating turbine blades, coolant passages beneath the blade surface travel in the longitudinal direction of the blades. The blades have a generally twisted configuration so that the coolant passages are generally not straight but also twisted in some extent. For purposes of illustration, however, the passages are shown herein as straight.

It is noted that coolant flow within such passages is subject to strong centrifugal force and also may be subject to Coriolis force. These conditions stratify the coolant flow such that the liquid travels as a thin film on the cooling passage wall, if the passage is not filled with liquid. The water-steam mixture within the passage flows in the form of film on the passage wall. This film flow tends to flow only on a portion of the passage wall so that such portion of the passage wall is more cooled than other portions of the wall on which no film exists. Non-uniform cooling causes relatively large thermal stress in the material so that the blades may suffer breakage.

One attempt to reduce the amount of thermal stress is disclosed in the U.S. Pat. No. 4,156,582. The coolant passages in this patent are provided by using preformed tubes located beneath an outer protective layer, and this layer is composed of an inner skin of high thermal conductivity and an outer skin for protection from hot corrosion. This approach to mollify local thermal stress suffers from difficulty and expense in manufacturing.

Another attempt to overcome these problems is feeding water to flow in the passage in full channel whereby the water contacts all of the passage wall. For example, U.S. Pat. No. 3,902,819 discloses the technique wherein the water flowing through the coolant passages is maintained at a super-critical pressure so that it cannot vaporize. However, this reduces substantially the amount of heat that can be absorbed because there is no utilization of heat absorption due to water-steam phase change. Further this approach requires that water fed in the cooling passages is introduced at the supercritical pressure.

Generally, water-steam mixture which has absorbed heat from the blades is drained into the flow of motive fluid from the cooling system of the blades. Draining of water-steam mixture is likely to cause impact erosion of the blades themselves or other parts including stationary parts of the turbine.

SUMMARY OF THE INVENTION

Accordingly, it is an object of this invention to provide liquid-cooled turbine blades of simple construction in which a coolant can effectively absorb heat substantially uniformly from coolant passage walls.

It is another object of the invention to provide such blades capable of being cooled by relatively a small quantity of cooling liquid which can be introduced into the cooling system of the blades.

It is still another object of the invention to prevent the draining of coolant which has absorbed heat from turbine blades from causing erosion of the parts of the turbine.

According to one aspect of this invention, the apparatus for cooling turbine blades comprises: liquid-flow coolant passage means travelling substantially longitudinally within the blade and adapted to be fed with coolant in a liquid state at a first blade root portion; nozzle means provided within said blade at an outer end portion thereof for converting coolant flow in the liquid state to mist-flow; channel means for communicating said liquid-flow coolant passage means with the nozzle means; mist-flow coolant passage means fed by the nozzle means and travelling substantially longitudinally within the blade toward a second blade root portion; and draining means for discharging waste coolant from the second blade root portion; wherein the coolant flows in the liquid state under centrifugal force through the liquid-flow coolant passage means toward the blade outer end portion and through the channel means toward the nozzle means, and the coolant flows through the mist-flow coolant passage in a mixture of very small droplets and gaseous vapor toward the second blade root portion and the draining means.

BRIEF DESCRIPTION OF THE DRAWINGS

Other objects and features of this invention will be more fully understood from the following description in conjunction with the drawings in which.

Figure 2:
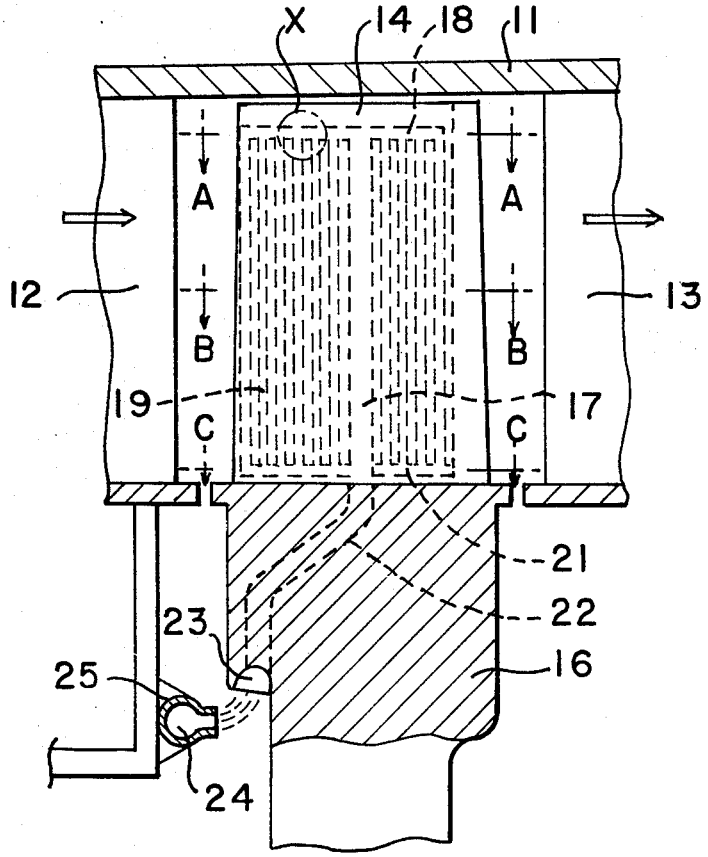
FIG. 2 is an elevational view of a turbine blade incorporating one embodiment of cooling apparatus according to this invention.
Figure 3A:
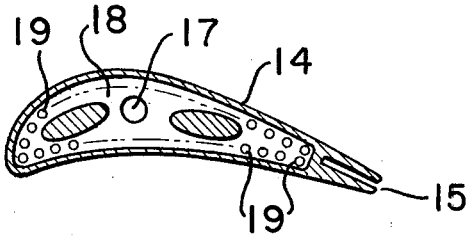
FIG. 3(*a*) shows a cross-sectional view, taken along line A—A of the embodiment shown in FIG. 2.
Figure 3B:
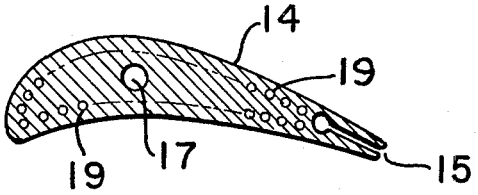
Figure 3C:
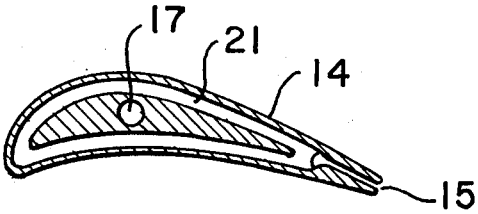
Figure 4:
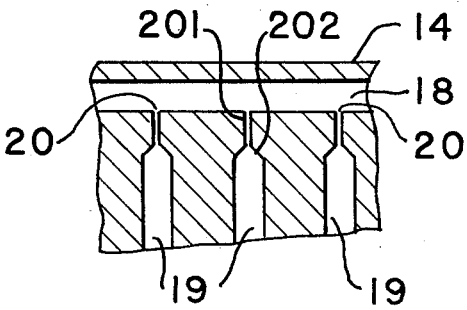
Figure 5:
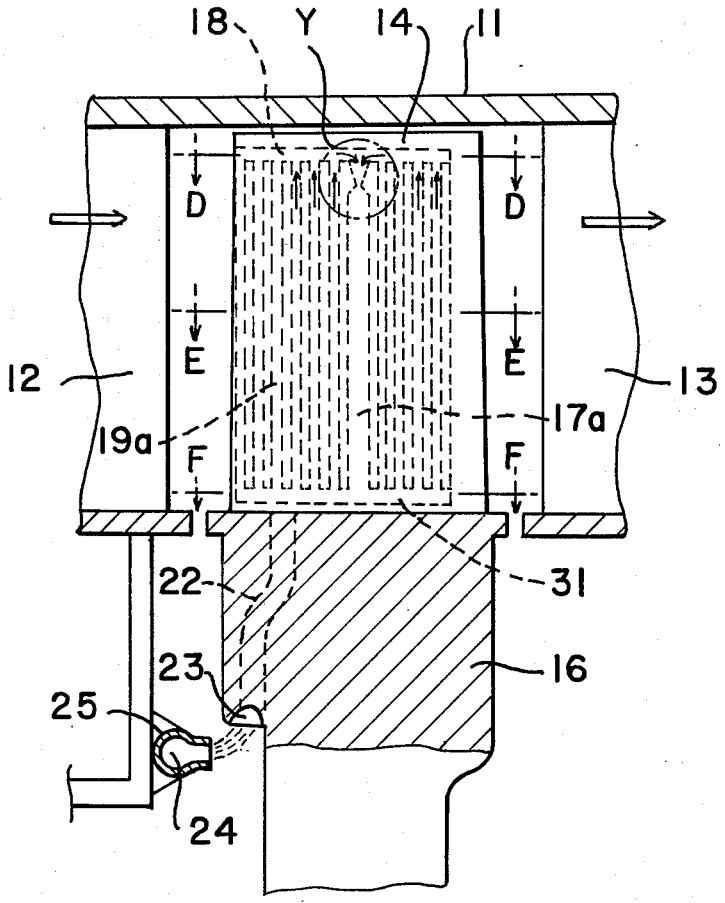
Figure 6A:
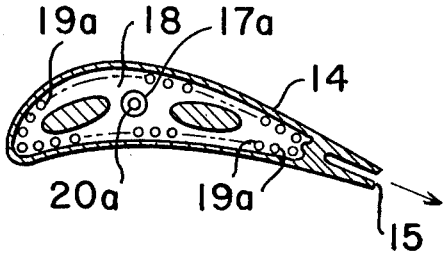
Figure 6B:
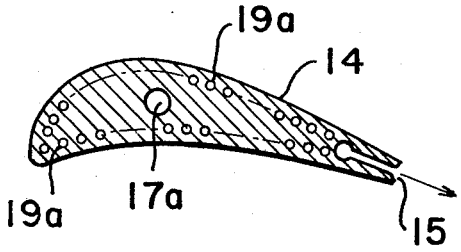
Figure 6C:
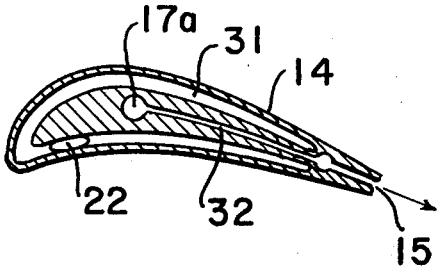
Figure 7:
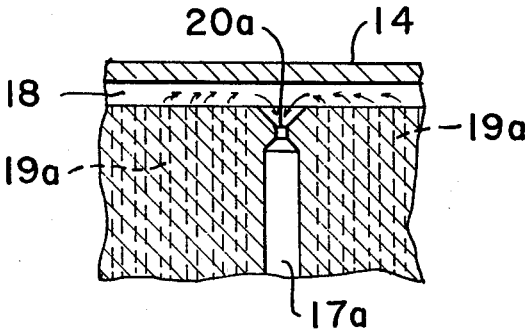

FIG. (3*b*) shows a cross-sectional view taken along line B—B of the embodiment shown in FIG. 2;

FIG. 3(*c*) shows a cross-sectional view, taken along line C—C of the embodiment shown in FIG. 2;

FIG. 4 is a detailed cross-sectional view of the portion marked X, as shown in FIG. 2;

FIG. 5 shows an elevational view of a turbine blade incorporating another embodiment of cooling apparatus according to the invention;

FIG. 6(*a*) shows a cross-sectional view, taken along line D—D of the embodiment shown in FIG. 5;

FIG. 6(*b*) shows a cross-sectional view taken along line E—E of the embodiment shown in FIG. 5;

FIG. 6(*c*) shows a cross-sectional view taken along line F—F of the embodiment shown in FIG. 5; and FIG. 7 shows a detailed cross-sectional view of the portion marked Y, as shown in FIG. 5.

DETAILED DESCRIPTION OF THE PREFERRED EMBODIMENTS

Figure 1:
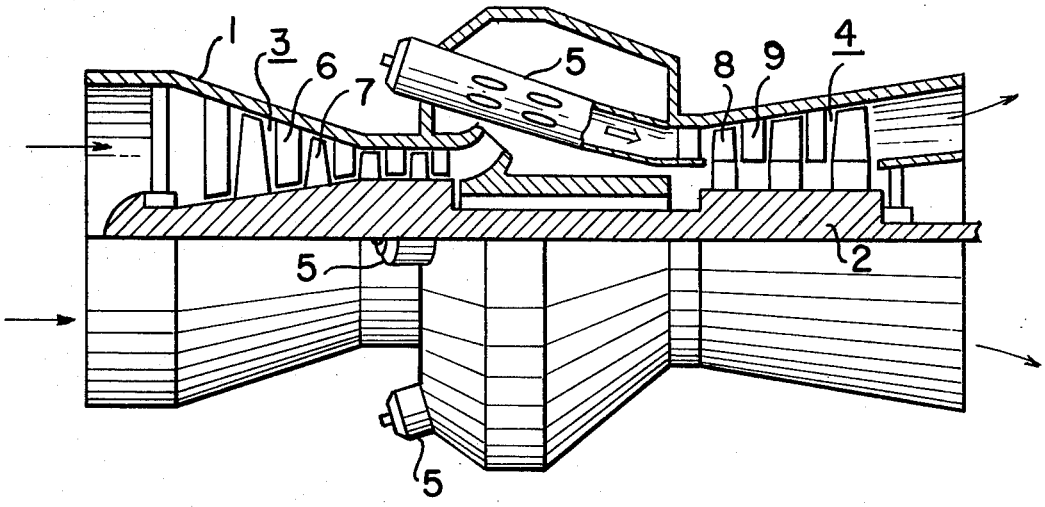
FIG. 1 shows a schematic elevational view, partially cut away, of a gas turbine of constant pressure combustion type, to which this invention can be applied.

Referring now to FIG. 1, a gas turbine of constant pressure combustion type is shown as one example to which this invention can be applied. The turbine has a generally cylindrical casing 1 encasing a rotor shaft 2. Along this rotor shaft 2, there are mounted a compressor, generally indicated at 3, and a power turbine, generally indicated at 4. A combustion chamber 5 is positioned between the compressor 3 and the power turbine 4. The compressor 3 compresses air into the chamber 5 for combustion with injected fuel. High pressure and high temperature gas, thus obtained, is introduced to the power turbine 4 and expands therein to give the shaft 2 rotating kinetic energy.

In FIG. 1, the compressor 3 is of axial flow type and has guide blades 6 and rotating blades 7, these blades being arranged alternately along the axis. The power turbine 4 has blades 8 mounted on the shaft 2 and stationary vanes 9 mounted on the casing 1. The blades 8 and the vanes 9 are disposed one after the other along the axis.

Throughout the drawings from FIG. 2 through FIG. 7, which illustrates preferred embodiments according to this invention, similar or identical parts are indicated by the same reference numerals.

Referring to FIG. 2, there is shown a portion of a power turbine, such as that shown in FIG. 1, which is furnished with blades incorporating one embodiment of the cooling apparatus according to this invention. Reference numeral 11 indicates a casing which corresponds to the casing 1 in FIG. 1; numerals 12 and 13 indicate vanes secured to the inner wall of the casing 11, corresponding to the vanes 9 in FIG. 1, and numeral 14 indicates a blade arranged between the vanes 12 and 13, corresponding to the blades 8 in FIG. 1. Motive fluid gas flows in the direction from the vane 12 towards the vane 13 as indicated by arrows.

As shown in FIGS. 3(*a*), 3(*b*), and 3(*c*), the blade 14 has an external configuration similar to well-known turbine blades except that there is provided a groove 15 which extends and opens along a trailing edge of the blade. The blade 14 is fixedly mounted at its root portion on a disc 16 which is, in turn, mounted on a shaft, such as shaft 1 of FIG. 1.

A first coolant passage 17 of relatively large diameter extends from the blade root portion to the blade outer end portion and is positioned at about the middle portion within the blade 14, as shown in FIG. 3. The passage 17 may be fabricated by a machine such as a drill and opens at the blade root end. An extremity of the passage 17 in the blade outer end portion communicates with a channel 18 provided within the blade 14 near the blade tip as shown in FIG. 3(*a*).

A plurality of second coolant passages 19 beneath the surface of the blade 14 travel longitudinally and approximately in parallel to one another with equal distance therebetween about the periphery of the blade 14, as shown in FIG. 3. These second passages have smaller diameter than that of the first passage 17, but may also be fabricated by a machine such as a drill.

Referring to FIG. 4, the channel 18 communicates with each of the second passages 19 at its outer extremity through an individual nozzle 20 having a small diameter portion 201 and a tapered diameter portion 202. The nozzle 20 causes relatively high pressure liquid, such as water, in the channel 18 to flash into the second passages 19 as a flowing mist of tiny liquid coolant droplets.

Referring again to FIG. 2, the second passages 19 at the root end portion thereof communicate with a drain passage 21 provided in the blade root portion as shown in FIG. 3(*c*). The drain passage 21 also communicates with the groove 15 at a root end portion thereof, the groove 15 extending along the trailing edge of the blade 14 as set forth hereinbefore.

Provided within the disc 16 is a conduit 22 for communication between the blade root end opening of the first passage 17 and a gutter 23. The gutter 23 is located on a side wall of the disc 16 such that the open portion of the gutter faces the axis of the rotor shaft. A coolant feeder 25, which may be mounted on the vane 12, for example, sprinkles coolant towards the open portion of the gutter 23.

In operation, water 24, for example, as coolant is fed to the feeder 25 when the blades 14 rotate with the disc 16 and sprinkled over the gutter 23. Water received in the gutter 23 is subject to centrifugal force and is introduced through the conduit 22 to the first coolant passage 17, where it quickly absorbs heat. Water of relatively high temperature in the first passage 17 and channel 18 is subject to strong centrifugal force due to rotation of those passages so that pressure on such water becomes high enough to keep the water in its liquid phase. Thus the first passage 17 and the channel 18 can be filled with water in liquid phase.

In this embodiment the first passage 17 forms a liquid coolant passage.

Water of relatively high pressure and temperature within the channel 18 flashes into each of the second passages 19 through the nozzles 20 with accompanying instantaneous expansion and cooling. Accordingly, water in liquid phase is changed to mist flow comprising extremely fine water droplets, each having a diameter of around 1 to 3 microns. Thus, liquid coolant enters into the second passages 19 as mist.

It should be noted that mist comprising fine particles of around 1 micron to 3 microns diameter is minimally affected by centrifugal force or by Coriolis force, so that mist flow can contact the whole inner wall of the second passages 19. Such mist flows from the blade outer end portion toward the blade root portion smoothly against centrifugal force acting toward the blade end direction. The mist flow absorbs heat from all around the inner surface of the second passages 19. In this course, there occurs at least to some extent a liquid water-to-steam phase change through heat absorption.

In this embodiment, the second passages 19, therefore, form mist-flow coolant passages. Thus, a mixture of steam and liquid water mist is introduced to the drain passage 21 and the groove 15. Then such mixture flows from the blade to be mixed with the motive fluid.

According to this embodiment, a coolant loop comprises a liquid phase coolant passage and mist-flow coolant passages. In each of the passages, the coolant flowing therethrough contacts the whole inner surface of the passages so that the coolant absorbs heat from all the inner surface of the passages. In the second or mist coolant passages, there is heat absorption due to liquid water-steam phase change and this also contributes to provide relatively high cooling efficiency. Further, there is no danger that strong local thermal stress will occur so that it is not necessary to employ complicated construction for relaxing such stress. Blades of relatively simple construction can be utilized.

Water sprinkled to the gutter 23 flows through the conduit 22 to the first passage 19 or liquid coolant passage due to the centrifugal force which also maintains the water within the liquid coolant passage in liquid phase without vaporizing. Thus there is no need that water be introduced into the liquid coolant passage at high pressure, whereby a pumping system for feeding high pressure water is not necessary.

This embodiment provides relatively high cooling efficiency, as described above, and further, the amount of water necessary for flowing in the system is reduced since it is not necessary to keep all the passages full of liquid water. This gives the advantage that the amount of water required for the cooling system is relatively small.

In draining the coolant, including the steam and the liquid water mist, from the blade 14, also absorbs heat from the trailing edge portion of the blade 14 as travelling through the groove 15. Such coolant, finally, is discharged from the groove 15 in a manner that the kinetic energy of the discharged flow contributes to increase the output power of the turbine. The discharged flow from the cooling apparatus is mixed with the motive fluid so that there is substantially no fear of erosion of the turbine parts by ejection of the waste coolant.

Referring now to FIG. 5 through FIG. 7, which show another embodiment according to this invention, identical or similar parts are indicated by the same numerals, and the following explanation will be focused on the difference between the two embodiments for simplicity.

The basic difference between this embodiment and the first embodiment resides in the reverse flow of the coolant through the apparatus. In this embodiment, the coolant flows through: the conduit 22; a passage 31; passages 19*a*, analogous to second passages 19; the channel 18; a passage 17*a*, analogous to the first passage 17; a drain passage 32 (shown in FIG. 6(*c*)); and the groove 15.

In order to introduce the coolant from the conduit 22 to the passage 19*a*, there is provided the passage 31, as shown in FIG. 6(*c*), which communicates with the conduit 22 and also the passages 19*a* but not with the groove 15 in the blade root portion. The passages 19*a* communicate directly with the channel 18 in the blade outer end portion. That is, nozzle 20 provided at each of the second passages 19 of the first embodiment is omitted. Instead of this, there is provided a single nozzle 20*a* within the passage 17*a* at the blade outer end portion. The channel 18 communicates with the passage 17*a* through the nozzle 20*a*, as shown in FIG. 7. The passage 17*a* communicates with the drain passage 32 which, in turn, communicates with the groove 15, in the blade root portion as shown in FIG. 6(*c*).

In operation, water sprinkled to the gutter 23 is introduced to the conduit 22, the passage 31, the passages 19*a*, and the channel 18, and is kept in liquid phase therein due to strong centrifugal force. Thus, the passages 31 and 19*a* and the channel 18 are filled with water in liquid phase without vaporization. Then liquid water under pressure is flashed into the passage 17*a* through the nozzle 20*a* which causes the water in liquid phase to be a flow of liquid water mist. The mixture of steam and liquid water mist is drained through the drain passage 32 and the groove 15. Thus, in this second embodiment, the passages 19*a* form the liquid coolant passages, while the passage 17*a* forms the mist coolant passage.

Accordingly, this second embodiment provides similar advantages to the first embodiment. Further, the number of nozzles required for changing liquid phase flow to liquid phase mist flow is less than that in the first embodiment, construction is more simplified so that greater ease of manufacturing can be obtained.

Although preferred embodiments are illustrated herein, this invention is not limited to these embodiments. It is to be understood that, within the spirit and nature of this invention, there may be many modifications and changes. For example, another passage of relatively large diameter may be added in parallel with the passage 17 or 17*a*.

What is claimed is:

1. In a blade for a gas turbine, apparatus for cooling said blade during rotation of the blade comprising:

liquid-flow coolant passage means travelling substantially longitudinally within said blade and adapted to be fed with coolant in a liquid state at a first blade root portion;

nozzle means provided within said blade at an outer end portion thereof for converting coolant flow in the liquid state to mist flow;

channel means for communicating said liquid-flow coolant passage means with said nozzle means;

mist-flow coolant passage means fed by said nozzle means and travelling substantially longitudinally within said blade toward a second blade root portion; and draining means for discharging waste coolant from said second blade root portion;

wherein, said coolant flows in the liquid state under centrifugal force through said liquid-flow coolant passage means toward the blade outer end portion and through said channel toward said nozzle means, and said coolant flows through said mist-flow coolant passage in a mixture of very small droplets and gaseous vapor toward the second blade root portion and said draining means.

2. In a blade for a gas turbine, apparatus for cooling said blade according to claim 1, wherein said liquid-flow coolant passage means comprises at least one passage of relatively large diameter within said blade at the middle portion thereof, and said mist-flow coolant passage means comprises a plurality of passages of relatively small diameter within said blade beneath a surface thereof.

3. In a blade for a gas turbine, apparatus for cooling said blade according to claim 1, wherein said liquid-flow coolant passage means comprises a plurality of passages of relatively small diameter within said blade beneath a surface thereof, and said mist-flow coolant passage means comprises at least one passage of relatively large diameter within said blade at the middle portion thereof.

4. In a blade for a gas turbine, apparatus for cooling said blade according to claim 1, 2 or 3, wherein said nozzle means comprises a relatively small diameter portion and a tapered diameter portion connected coaxially in series relation expanding along the direction of coolant flow.

5. In a blade for a gas turbine, apparatus for cooling said blade according to claim 1, 2 or 3, wherein said draining means includes a groove extending and opening along a trailing edge of said blade.

6. In a blade for a gas turbine, apparatus for cooling said blade according to claim 4, wherein said draining means includes a groove extending and opening along a trailing edge of said blade.

7. A method for cooling a gas turbine blade during rotation of the blade comprising the steps of:

feeding coolant in a liquid state to said blade at a root portion thereof;

flowing said coolant through at least one first passage within said blade in a liquid state toward an outer blade end portion by utilizing centrifugal force;

converting said liquid state coolant to a mist of discrete droplets;

flowing said coolant in the mist state through at least one second passage within said blade toward the blade root portion; and draining said coolant which has absorbed heat and comprises a mixture of steam and liquid mist from said blade.

* * * * *